US006045191A

United States Patent [19]

Piretti

[11] Patent Number: 6,045,191

[45] Date of Patent: Apr. 4, 2000

[54] ARM-REST FOR A CHAIR AND A CHAIR COMPRISING THIS ARM-REST

[75] Inventor: Giancarlo Piretti, Bologna, Italy

[73] Assignee: Desital Holland B.V., Amsterdam Z.O., Netherlands

[21] Appl. No.: 09/085,104

[22] Filed: May 28, 1998

[30] Foreign Application Priority Data

May 28, 1997 [IT] Italy ..... TO97A0458

[51] Int. Cl.[7] ..... A47C 7/54

[52] U.S. Cl. ..... 297/411.37; 297/411.35

[58] Field of Search ..... 297/411.2, 411.35, 297/411.37, 411.31, 411.3, 116; 248/118, 118.1

[56] References Cited

U.S. PATENT DOCUMENTS 5,282,671 2/1994 Funk ..... 297/411.31

5,597,207 1/1997 Bergsten et al. ..... 297/411.37 X 5,597,208 1/1997 Bonutti ..... 297/411.37 X 5,749,628 5/1998 Synder et al. ..... 297/411.31 X

*Primary Examiner*—Milton Nelson, Jr.

*Attorney, Agent, or Firm*—Sughrue, Mion, Zinn, Macpeak & Seas, PLLC

[57] ABSTRACT

A chair arm-rest, particularly for an office chair, includes a supporting structure and an arm-rest structure movable relative to the supporting structure by movement of a user's forearm resting on the arm-rest between a shortened condition and a forwardly extended condition, in which the arm-rest can support the user's forearm better, for instance when performing a typewriting operation.

6 Claims, 6 Drawing Sheets

ARM-REST FOR A CHAIR AND A CHAIR COMPRISING THIS ARM-REST

BACKGROUND OF THE INVENTION

The present invention relates to chair arm-rests, particularly for office chairs, of the type comprising a supporting structure, which is to be connected to the chair structure, and an arm-rest structure mounted on the supporting structure.

SUMMARY OF THE INVENTION

The object of the present invention is that of providing an arm-rest which ensures adequate support to the arm of the chair occupant both in a rest condition, and when the user has its forearms outstretched forwardly, for example in order to perform a typewriting activity.

A further object of the invention lies in providing an arm-rest of the above indicated type which has a relatively simple and inexpensive structure and which is convenient and efficient in use.

In view of achieving these objects, the invention provides a chair arm-rest of the above indicated type, characterized in that said arm-rest structure is movable relative to the supporting structure between a shortened condition and a forwardly extended condition, in which it can support the occupant's forearm better, for example during performing of a typewriting operation, said arm-rest structure comprising a plurality of arm-rest sections having their ends mutually articulated to each other, so that the user can move the arm-rest structure, by means of the forearm itself which is resting thereabove, between said shortened condition, in which the arm-rest sections are superimposed on each other, and said extended condition, in which the arm-rest sections are arranged as an extension of each other.

In a preferred embodiment, the arm-rest structure comprises a lower element secured to the supporting structure, an intermediate element superimposed and articulated to the lower element around a first vertical axis, and an upper element superimposed and articulated to the intermediate element around a second vertical axis spaced from the first vertical axis, so that said upper element and said intermediate element define a crank-like linkage.

Due to this feature, the chair occupant, while keeping its forearms on the two chair arm-rests, can move the latter between the shortened condition and the forwardly extended condition by moving its two forearms similarly to the movement performed by a connecting-rod in a crank-linkage.

The arm-rest according to the invention thus enables the user to carry out the arm-rest adjustment operation without removing its forearm from the arm-rest. In other words, the user can carry out the various operations which are requested to him while keeping the forearms in contact with the two chair arm-rests, which are able to perform the movements of these forearms while supporting them adequately and thus providing an indefinite number of possible working positions corresponding to the various points of the path followed by the arm-rest.

In the above mentioned preferred embodiment, each articulation is made by means of a rolling bearing, preferably a thrust ball bearing. Furthermore, the upper element of the arm-rest structure has an upper surface defining a cavity for receiving the forearm. Thus, the user is able to transmit the lateral forces applied by the forearms to the upper elements of the two arm-rests more easily, when the arm-rests must be moved between their shortened condition and their extended condition or in order to bring them to any intermediate position.

Naturally, the invention also provides a chair, particularly an office chair, comprising two arm-rests of the above indicated type.

BRIEF DESCRIPTION OF THE DRAWINGS

Further features and advantages of the invention will become apparent from the description which follows with reference to the annexed drawings, given purely by way of non limiting example, in which.

DETAILED DESCRIPTION OF THE INVENTION

Figure 2:
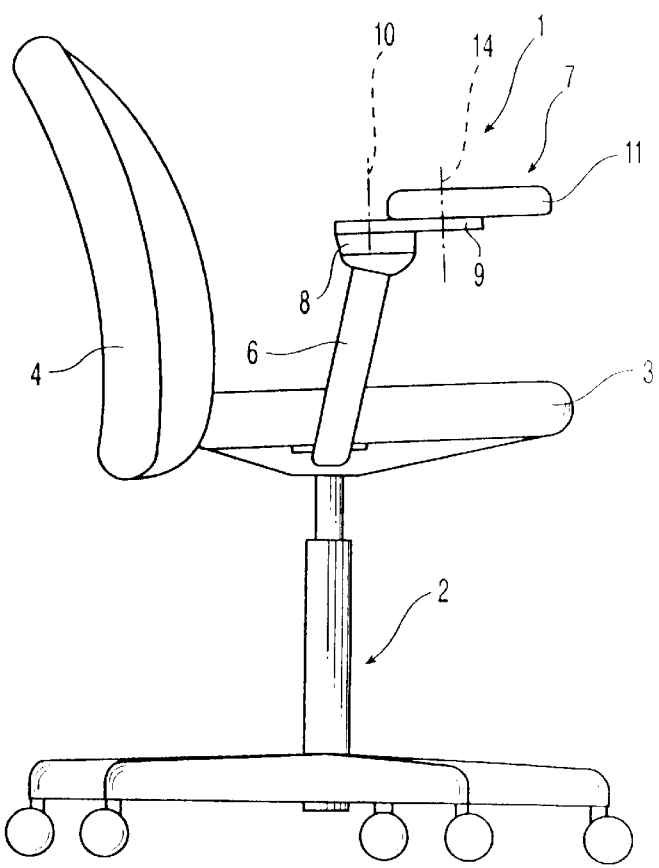
FIG. 2 is a side view similar to that of FIG. 1, with the arm-rests in the forwardly extended condition.

In the drawings, numeral 1 generally designates an office chair comprising a base structure 2 carrying a seat 3 and a backrest 4 as well as a pair of arm-rests 5. Each arm-rest 5 comprises a supporting structure 6 secured to the base structure 2 of the chair and carrying an arm-rest structure 7.

Naturally, the shape of the base structure 2, the seat 3, and the backrest 4 which is shown in the annexed drawings is given purely by way of example. It is indeed clearly apparent that the invention is applicable to any chair configuration, with any configuration for the base structure, the seat and the backrest. The same naturally applies also to the supporting structure 6 of the arm-rest, which can also be made in a manner different from what is illustrated purely by way of example in the drawings.

In the illustrated example, the structure of the arm-rest 7 comprises a lower element 8 secured to the upper end of the respective supporting structure 6, an intermediate element 9 in form of an extended plate superimposed to the lower element 8 and having one end articulated to element 8 around a vertical axis 10; and finally an upper element 11, comprising an extended plate 12 covered at its top by a padding 13. The plate 12 is superimposed to the intermediate element 9 and has one end articulated to the end of element 9 opposite to the articulation axis 10, around a second vertical axis 14, spaced from axis 10.

Figure 4:
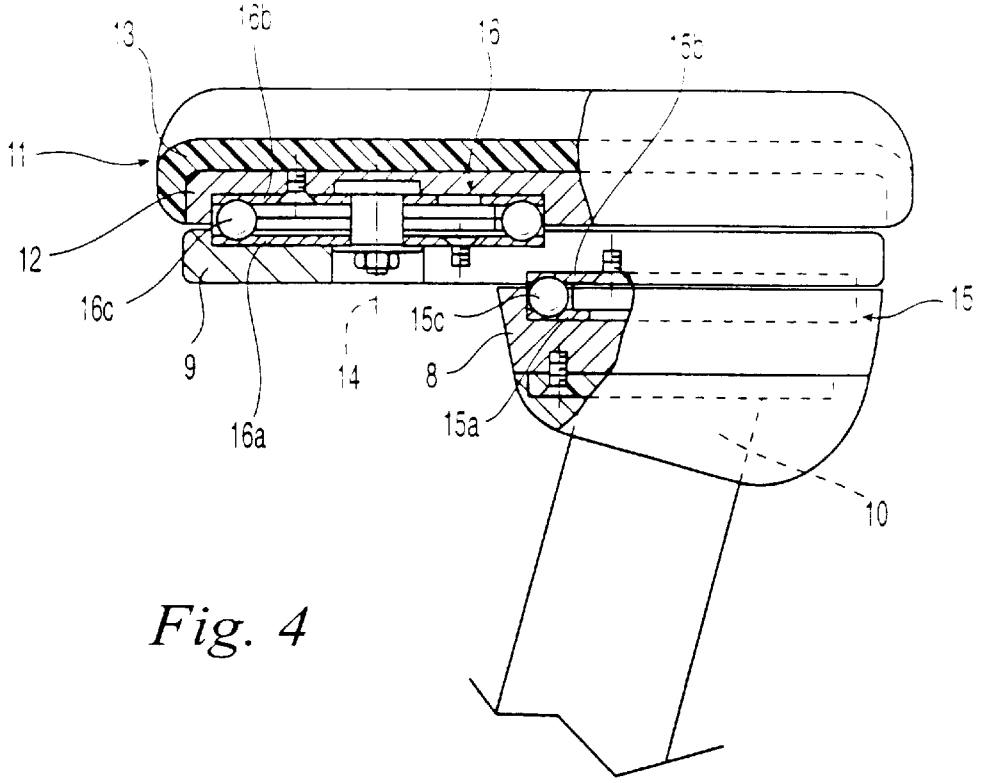
FIG. 4 is a view at an enlarged scale and partially in cross section of the detail of the arm-rest of FIG. 1.
Figure 5:
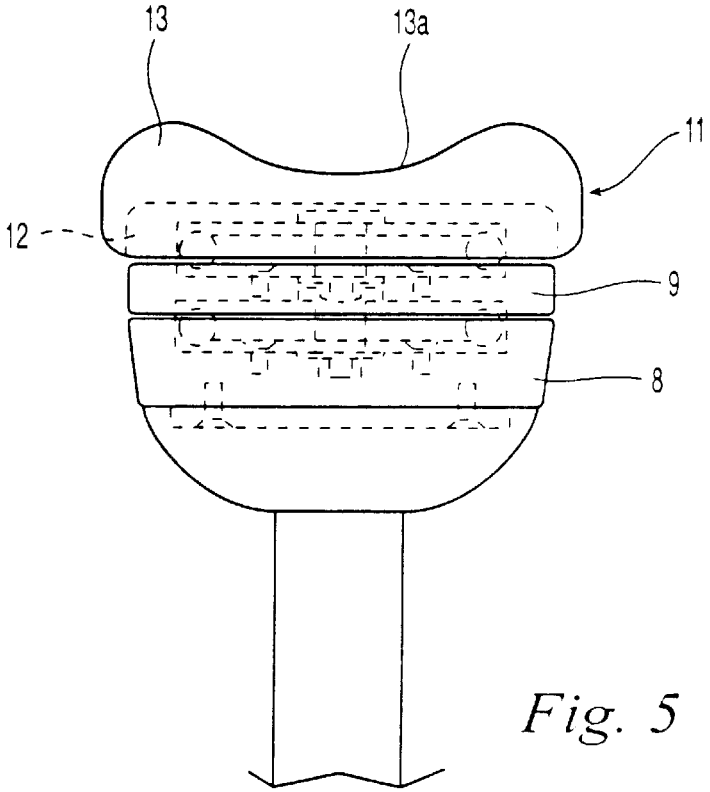
FIG. 5 is a front view of the arm-rest of FIG. 4.

As shown in FIG. 4, in the preferred embodiment of the invention the articulations around axes 10, 14 are made by means of two thrust ball bearings 15, 16. These bearings have opposite plates 15*a*, 15*b* and 16*a*, 16*b* respectively secured by screws to the lower element 8 and the intermediate element 9, and intermediate element 9 and upper element 12. Between each pair of opposite plates there is interposed a ball cage 15*c*, 16*c* adapted to reduce friction as much as possible in the relative rotation of said elements.

The padding 13 of the upper element 12, which for instance is made of foamed plastic material with a covering cloth, has an upper surface defining a cavity 13*a* shaped so as to act as a seat for the forearm.

As it will be clearly apparent from the foregoing description, the upper element 11 and the intermediate element 9 form a sort of crank-linkage articulated to the lower element 8. This system is thus able to assume any position determined by the rotation of the intermediate element 9 relative to lower element 8 around axis 10 and the simultaneous rotation of the upper element 11 around axis 14 relative to the intermediate element 9.

Figure 3A:
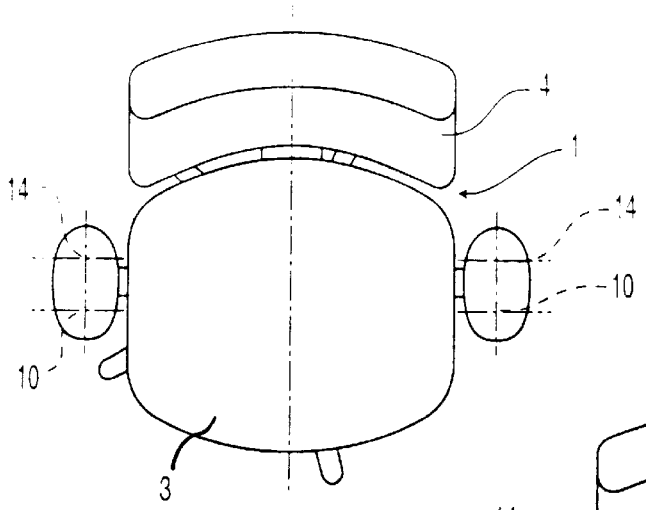
FIGS. 3A, 3B, 3C, 3D show a plan view of the chair of FIGS. 1, 2 in four different positions of the arm-rests.
Figure 6:
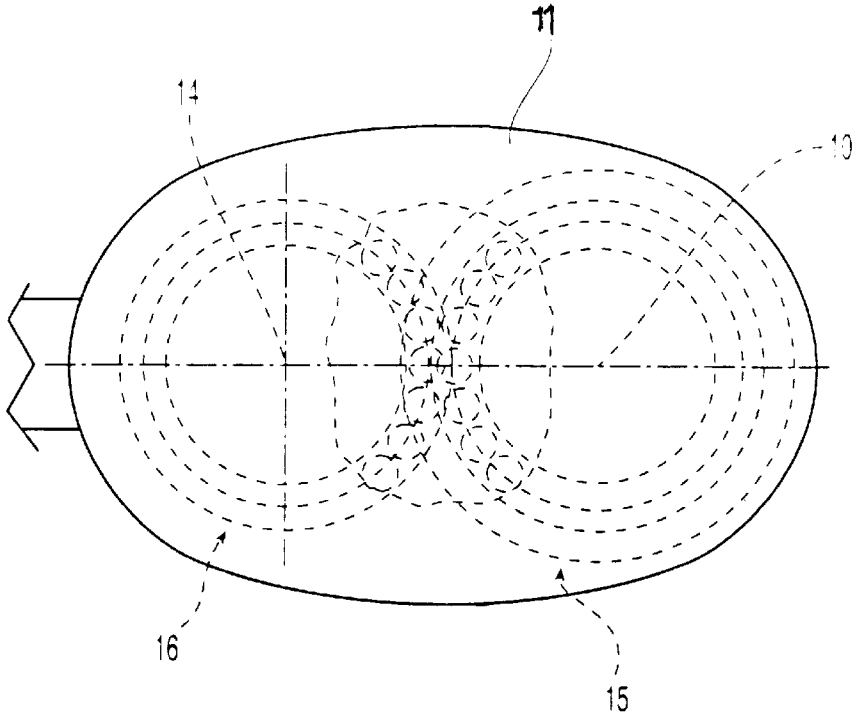
FIG. 6 is a plan view of the arm-rest in the condition shown in FIG. 4.
Figure 7:
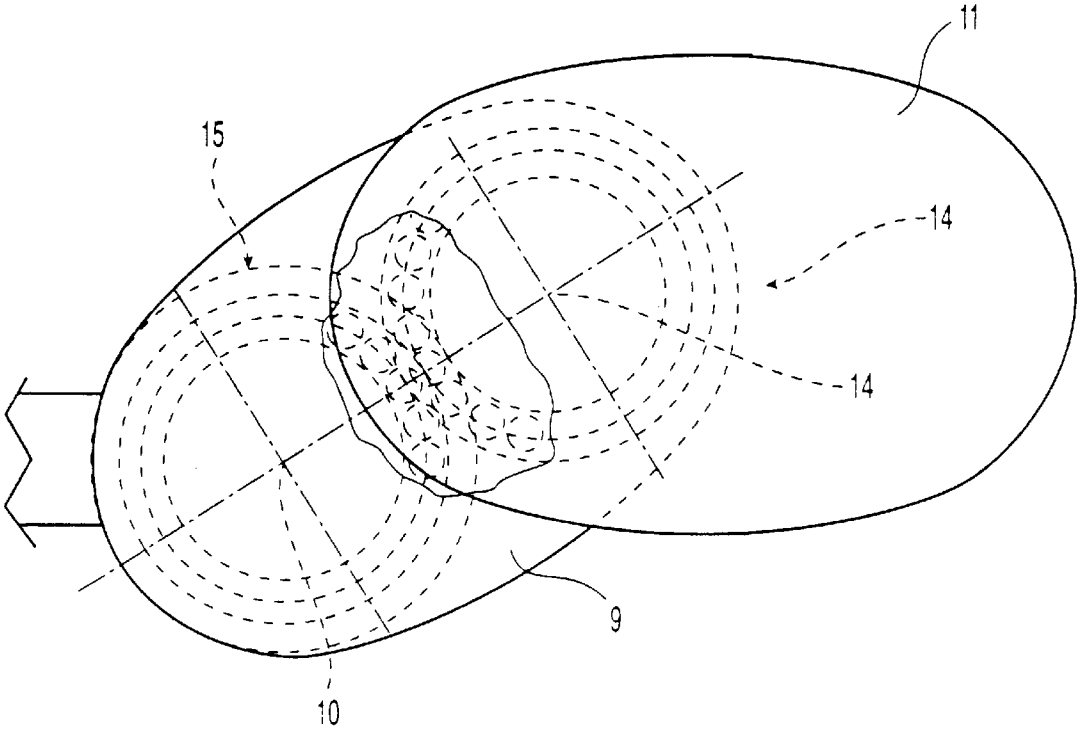
FIG. 7 is a plan view of the arm-rest in a different position thereof.

FIG. 3A shows a plan view of the chair with its arm-rests in the shortened condition, in which the intermediate element 9 is arranged with axis 14 located at the rear of axis 10 and upper element 11 superimposed to intermediate element 9. The position shown in FIG. 3A is the same shown in FIGS. 1, 4 and 6.

Figure 3B:
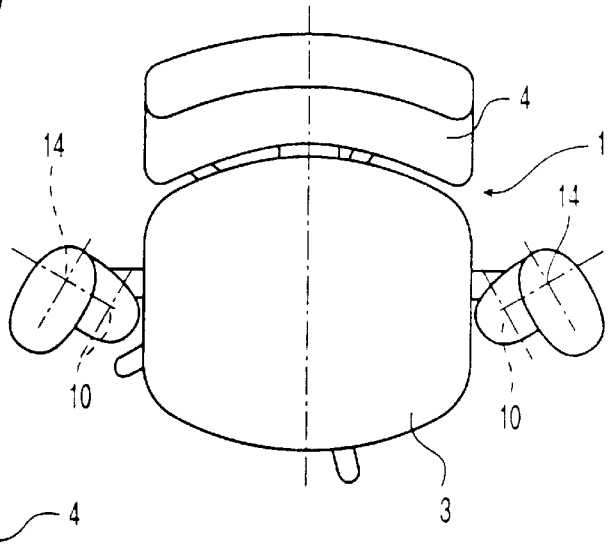
Figure 3C:
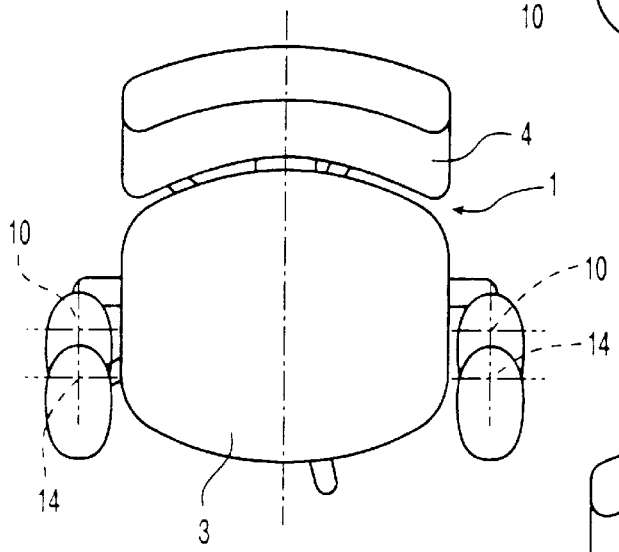
Figure 8:
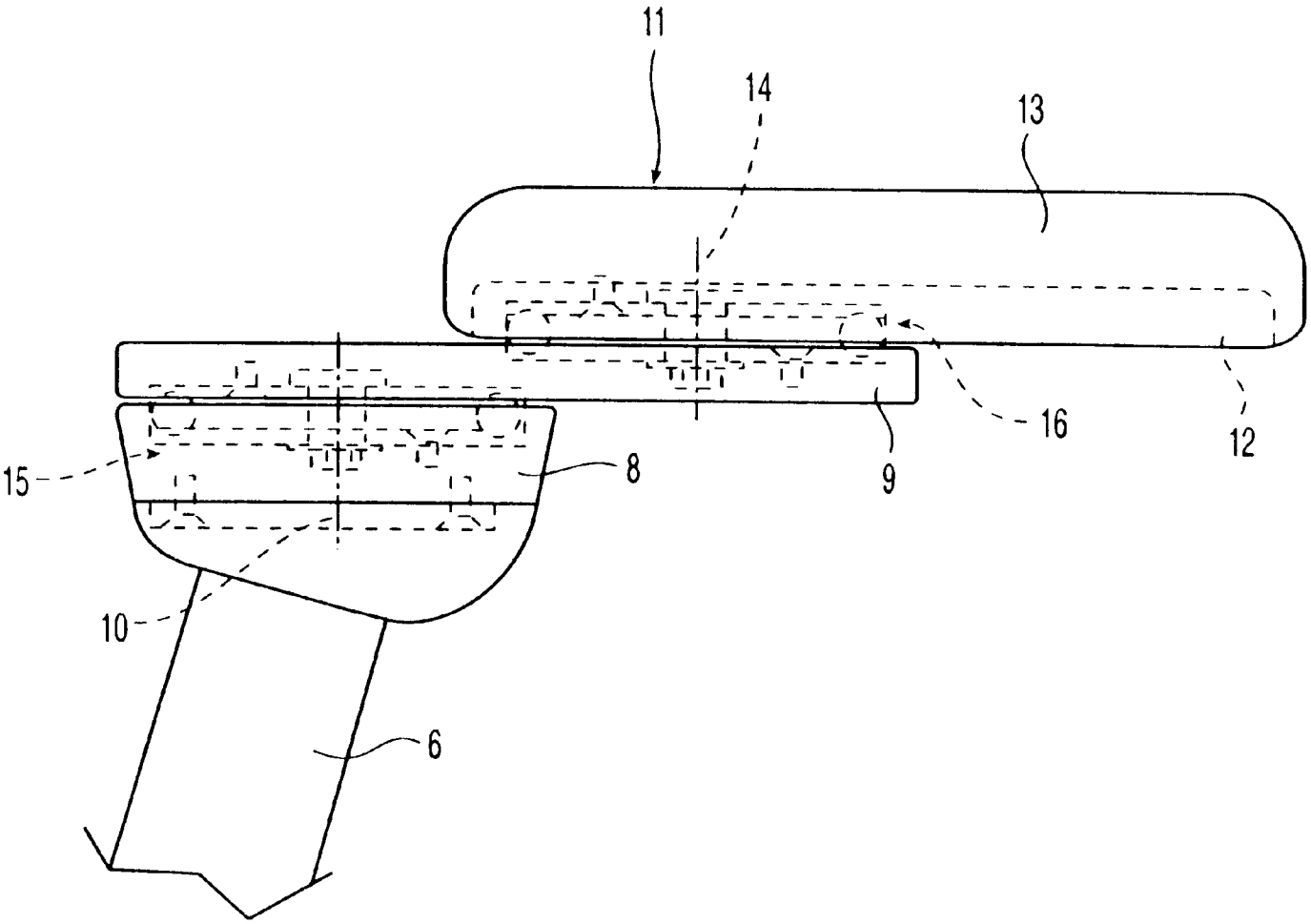
FIG. 8 is a side view and at an enlarged scale of the arm-rest in the condition shown in FIG. 2.

FIG. 3C shows a plan view of the chair with the arm-rest in the condition of maximum forward extension. This position is also shown in FIGS. 2 and 8. In this condition, the intermediate element 9 is rotated with axis 14 arranged in front of axis 10, and the upper element 11 is arranged as an extension of intermediate element 9.

Figure 3D:
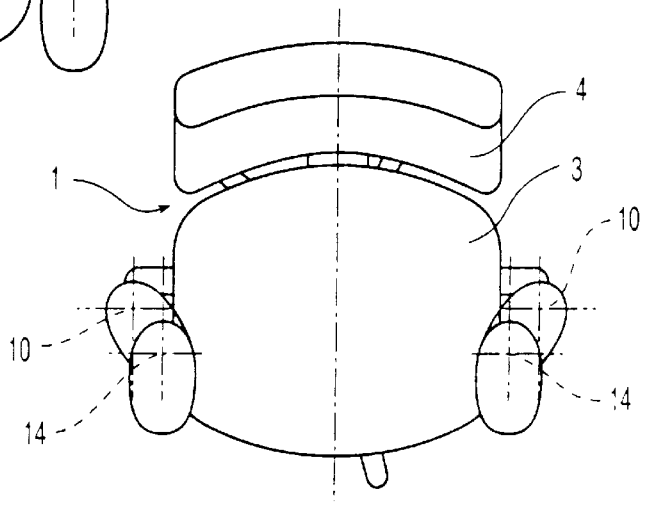

Due to the above described structure, the arm-rests according to the invention enable the user to bring the arm-rests from the condition shown in FIG. 3A to the condition shown in FIG. 3C by means of the forearms themselves resting on the two upper elements 11. By moving these forearms, the user is indeed able to cause the crank system constituted by the upper element 11 and the intermediate element 9 to perform the movements requested to shift from one position to the other. FIG. 3B shows an intermediate position between the two end positions which have been described above. FIG. 3D shows still a further position partially retracted with respect to the position of FIG. 3C.

Figure 1:
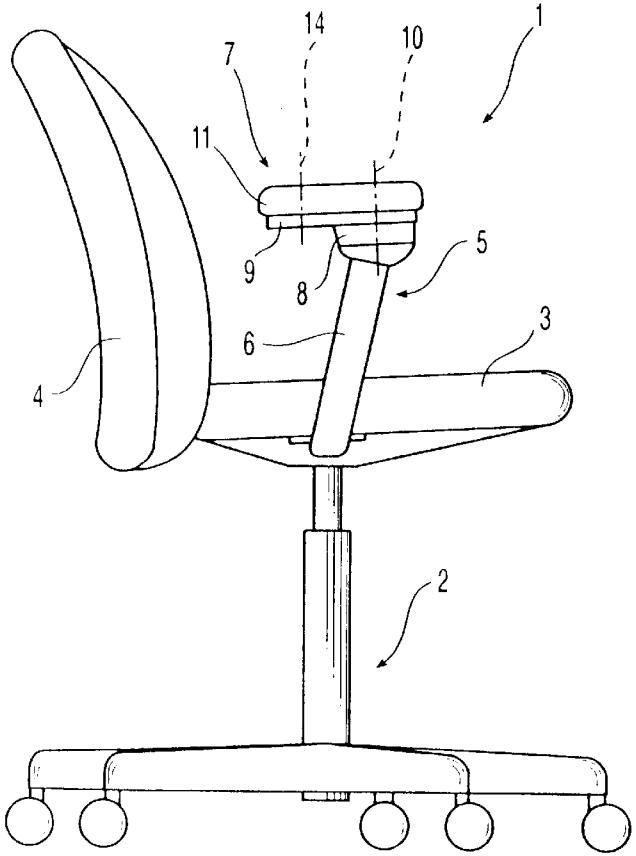
FIG. 1 is a side view of an embodiment of the chair according to the invention, with its arm-rests in the shortened condition.

The configuration shown in FIG. 1 is preferable when the chair occupant is in a rest condition. When it is instead requested to perform a typewriting operation, the occupant outstretches its forearms towards the working desk while keeping the forearms themselves in contact with the upper elements 11 of the two arm-rests. By moving these upper elements according to the rotation of the crank system which has been described above, the user can thus arrive with its hands above a keyboard provided on the working desk, with the arm-rest extended (for example in the condition of FIG. 3C) so as to support adequately the forearms. Naturally, if the user decides to arrange the arm-rests in a different position, it has only to move its arms accordingly, since the arm-rests follow the movements of the latter easily, also due to the provision of rolling bearings 15, 16.

Furthermore, as shown, the structure of the arm-rest according to the invention is extremely simple and made by a reduced number of parts and is therefore easy and inexpensive to manufacture.

Naturally, while the principle of the invention remains the same, the details of construction and the embodiments may widely vary with respect to what has been described and illustrated purely by way of example, without departing from the scope of the present invention.

Figure 9:
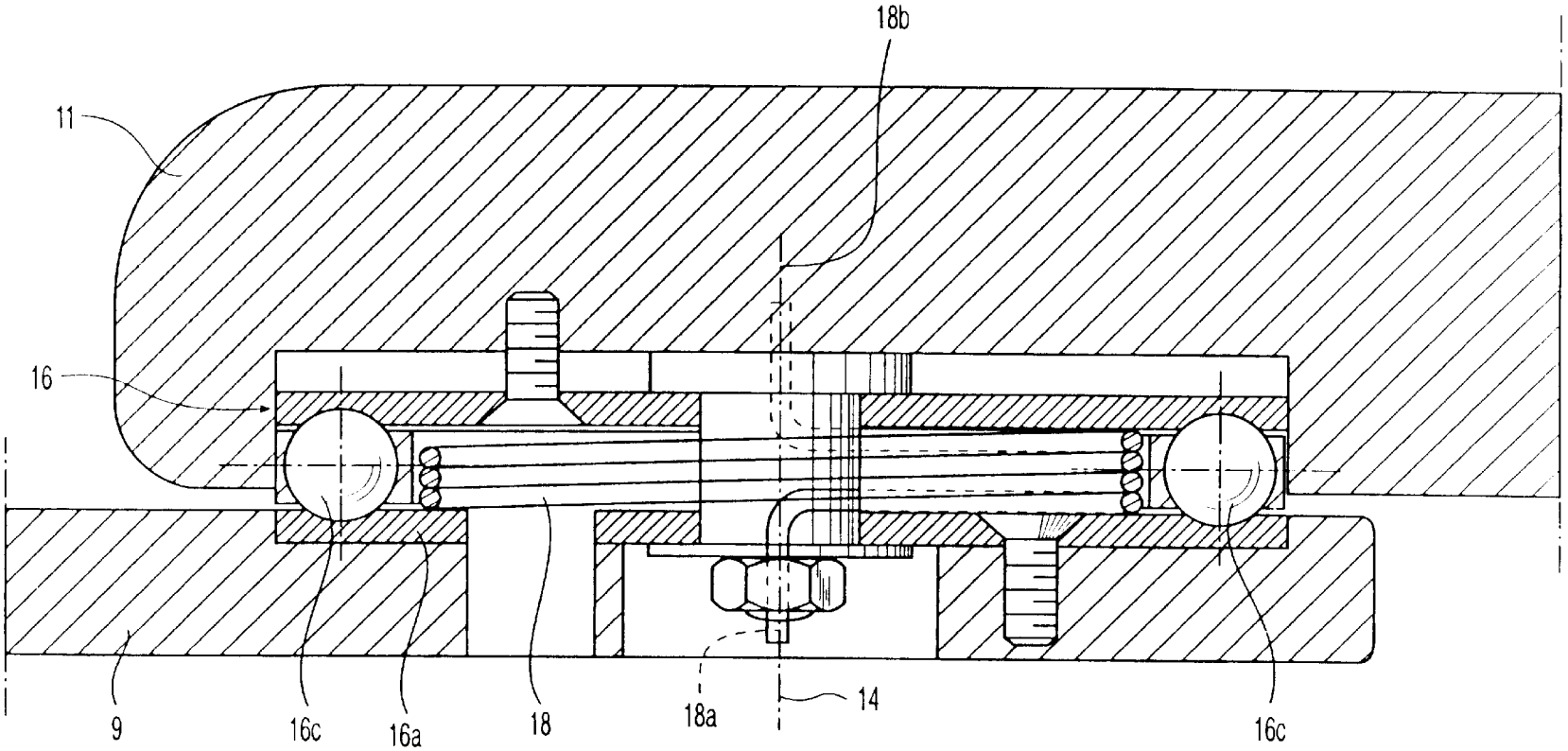
FIG. 9 shows a variant of a detail of the arm-rest according to the invention.

For example, each of the rolling bearings 15, 16 can be made as shown in FIG. 9 (with reference to bearings 16), i.e. including a helical spring 18 arranged centrally between the two opposite plates the bearing and having end tails 18*a*, 18*b* respectively connected to these plates so as to bias the arm-rest elements towards the configuration of minimum length. The spring 18 has a relatively low load, so that it does not hinder the operation by the user, but sufficient in order to bring the arm-rest back to the condition of minimum length when it is left free. Furthermore, between element 8 and element 9, and between the latter and element 11 there can be provided stop means in order to limit rotation of the movable elements of the arm-rest.

What is claimed is:

1. A chair arm-rest comprising a supporting structure, which is to be secured to a chair structure, and an arm-rest structure mounted on the supporting structure, wherein said arm-rest structure is movably mounted on the supporting structure for movement relative to the supporting structure between a shortened condition and a forwardly extended condition, in which the arm-rest structure can support a user's forearm, said arm-rest structure comprising a plurality of arm-rest sections having their ends mutually articulated to each other, so that the user can move the arm-rest structure by movement of the user's forearm resting thereon between said shortened condition, in which the arm-rest sections are superimposed on each other, and said extended condition, in which the arm-rest sections are arranged as an extension of each other, wherein the arm-rest structure comprises a lower element secured to the supporting structure, an intermediate element superimposed and articulated to the lower element around a first vertical axis, and an upper element superimposed and articulated to the intermediate element around a second vertical axis spaced from the first vertical axis, so that the upper element and the intermediate element define a crank-linkage which can be moved by the user's forearm resting on the arm-rest.

2. Arm-rest according to claim 1, wherein there are provided spring means biasing the arm-rest towards the shortened condition.

3. A chair comprising two arm-rests according to claim 1.

4. Arm-rest according to claim 1, wherein each of said articulations is made by means of a rolling bearing.

5. Arm-rest according to claim 4, wherein said rolling bearing is a thrust ball bearing.

6. Arm-rest according to claim 4, wherein the upper element has an upper surface defining a cavity for receiving the user's forearm.

* * * * *